US007261443B1

(12) United States Patent
Hayes, Jr.

(10) Patent No.: US 7,261,443 B1
(45) Date of Patent: Aug. 28, 2007

(54) DISAPPEARING LANDSCAPE LIGHT

(76) Inventor: James A. Hayes, Jr., 8706 Ridgemont Dr., Pineville, LA (US) 71361-2632

( * ) Notice: Subject to any disclaimer, the term of this patent is extended or adjusted under 35 U.S.C. 154(b) by 18 days.

(21) Appl. No.: 11/257,813

(22) Filed: Oct. 24, 2005

Related U.S. Application Data

(60) Provisional application No. 60/691,886, filed on Jun. 17, 2005.

(51) Int. Cl.
*F21V 21/34* (2006.01)

(52) U.S. Cl. ..... 362/385; 362/285; 362/386; 362/364; 362/372; 362/382; 362/526; 362/418; 362/430; 362/449; 362/493; 362/523

(58) Field of Classification Search ..... 362/285, 362/364, 382, 385, 418, 286, 372, 430, 449, 362/523, 526, 493
See application file for complete search history.

(56) References Cited

U.S. PATENT DOCUMENTS 4,180,850 A 12/1979 Bivens
4,974,134 A 11/1990 Bourne
4,984,139 A 1/1991 Goggia
5,003,441 A 3/1991 Crowe et al.
5,068,773 A 11/1991 Toth
5,072,345 A 12/1991 Goggia
5,142,463 A 8/1992 Panagotacos et al.
5,550,727 A 8/1996 Fenyvesy
5,628,558 A 5/1997 Iacono et al.
5,683,176 A 11/1997 Clendenin
6,067,012 A * 5/2000 Harding ..... 340/472
6,099,139 A 8/2000 Lapensee
2006/0002122 A1* 1/2006 Griffin ..... 362/493

FOREIGN PATENT DOCUMENTS

DE 20017751 U1 * 12/2000

* cited by examiner

*Primary Examiner*—Renee Luebke
*Assistant Examiner*—Mary Zettl
(74) *Attorney, Agent, or Firm*—Jones, Walker, Waechter, Poitevent, Carrere, & Denegre, L.L.P.

(57) ABSTRACT

An extendable lighting system having a main housing with a bottom wall and upwardly extending side walls. A lamp housing is retractable positioned within the main housing and a flexible diaphragm connects to the main housing above the bottom wall and connects to the lamp housing to create a substantially enclosed space between the diaphragm and the bottom wall. An air passage communicates with the enclosed space.

20 Claims, 6 Drawing Sheets

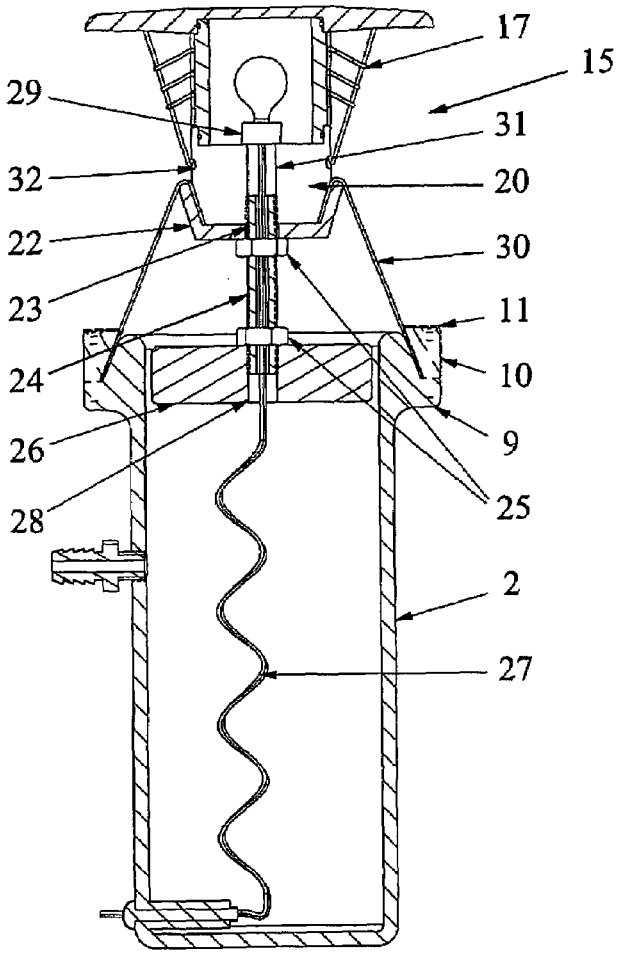
Figure 2A
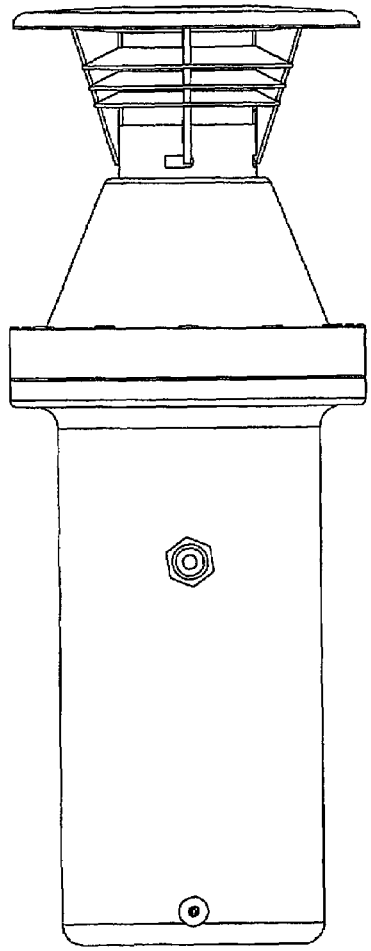
Figure 2B
Fig 2

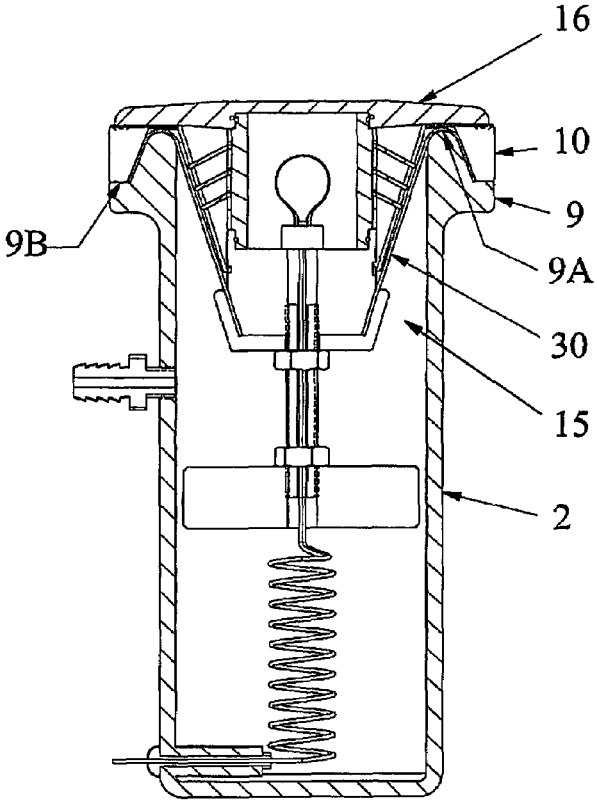
Figure 3A
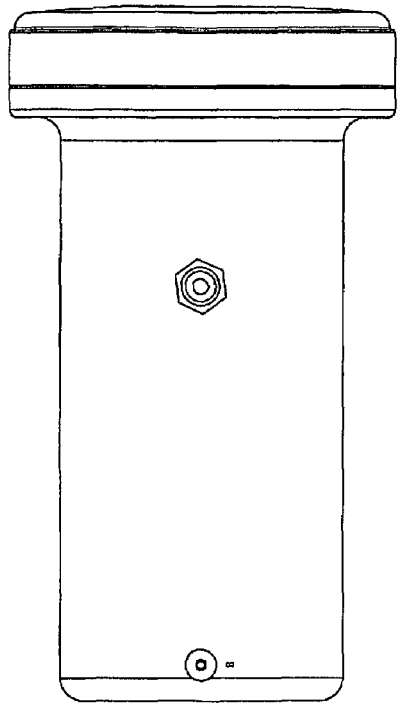
Figure 3B
Fig 3

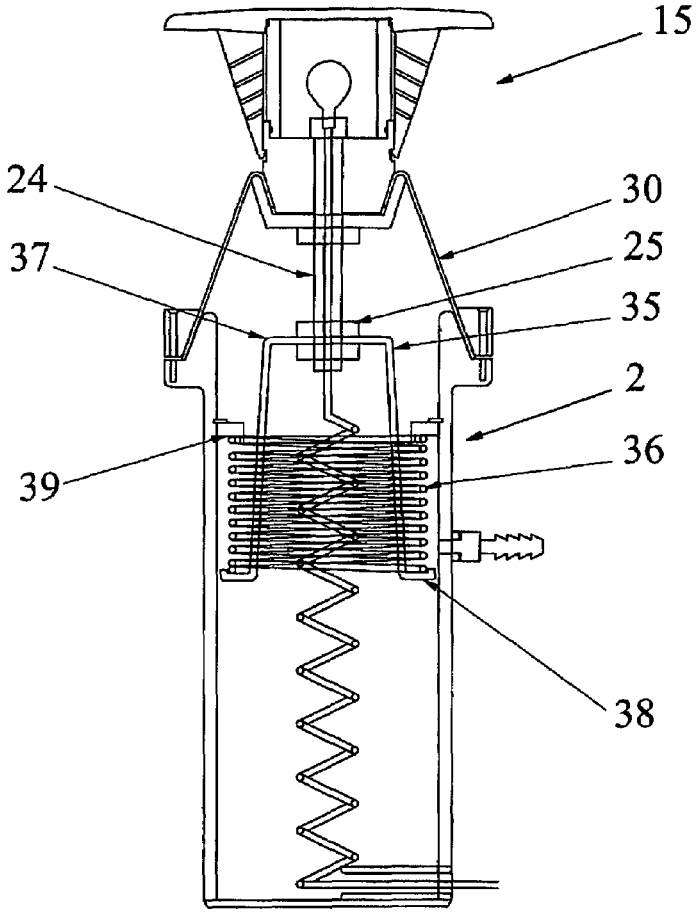
Figure 4A
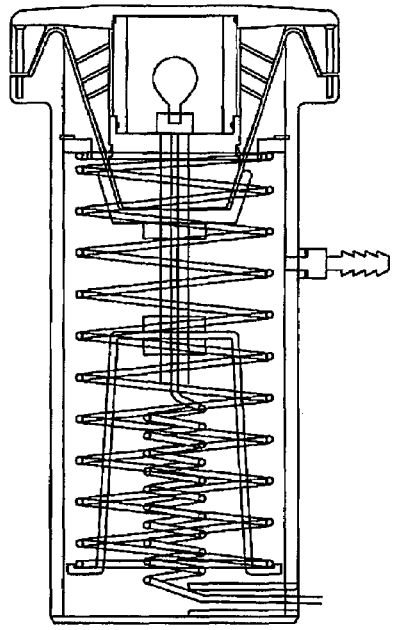
Figure 4B
Fig. 4

DISAPPEARING LANDSCAPE LIGHT

This application claims the benefit under 35 USC §119(e) of U.S. Provisional Application Ser. No. 60/691,886 filed Jun. 17, 2005, which is incorporated by reference herein in its entirety.

FIELD OF INVENTION

The present invention relates to extendable/retractable lighting systems and in one particular embodiment, relates to retractable landscape lights typically implanted in the ground along a path or walkway.

BACKGROUND

Retractable lighting systems, particularly landscape lights, are known in the art as can be seen in U.S. Pat. Nos. 5,628,558 to Iacono and 5,683,176 to Clendenin. These two patents disclose pneumatically operated devices which have an inner housing sliding within an outer housing. In pneumatically operated devices, O-rings are typically used to minimize airflow between the inner and outer housings. O-ring seals have the disadvantage of adding frictional resistance to the sliding action between the two housings. Additionally, O-ring seals must be kept fee of dirt and grit or they tend to fail prematurely. Of course, landscape lights being buried in the ground are subject to extremely dirty and gritty conditions, especially when combined with periodic rain. Moreover, since landscape lights may be installed in low areas, it is quite possible that they will at times be submerged during heavy rainfalls. Given these circumstances, there exists a need for improvements to the various prior art retractable lighting systems.

BRIEF DESCRIPTION OF DRAWINGS

FIG. 2A illustrates a sectional view of the embodiment of the extendable lighting system seen in FIG. 1 while in the raised position.

FIG. 2B is the external view of the FIG. 2A embodiment.

FIG. 3A illustrates a sectional view of the embodiment of the extendable lighting system seen in FIG. 1 while in the lowered position.

FIG. 3B is the external view of the FIG. 3A embodiment.

FIG. 4A illustrates a sectional view of an alternate embodiment of the extendable lighting system while in the raised position.

FIG. 4B illustrates a sectional view of the FIG. 4A embodiment while in the lowered position.

DETAILED DESCRIPTION OF INVENTION

Figure 1:
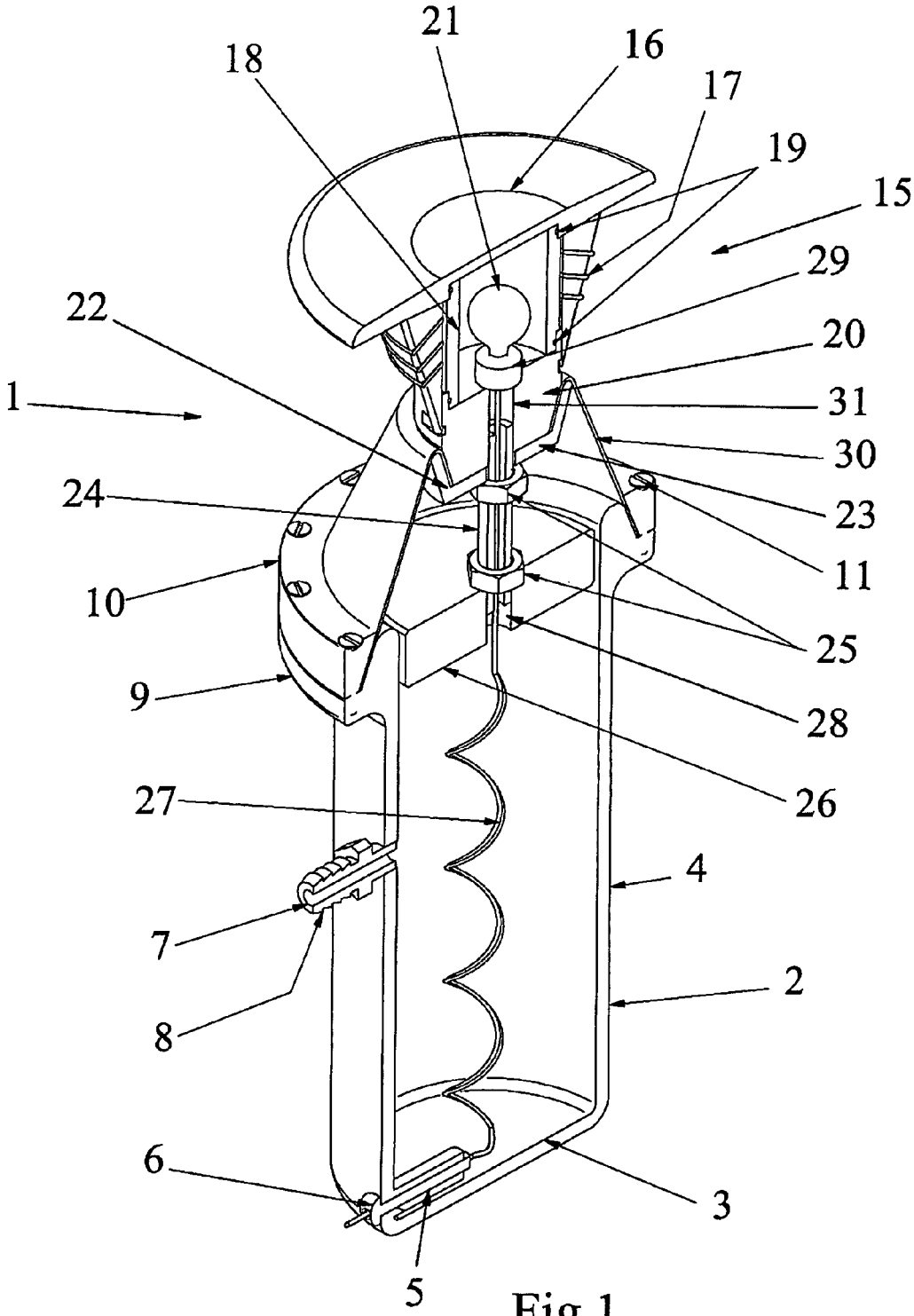
FIG. 1 illustrates an internal perspective view of one embodiment of the extendable lighting system of the present invention.

One embodiment of the extendable lighting system of the present invention is seen in FIG. 1. This particular embodiment is in the form of landscape light 1. Landscape light 1 generally comprises a main housing 2, a lamp housing 15, and a flexible diaphragm 30. The substantially cylindrical main housing 2 seen in this embodiment will include a bottom wall 3 and sidewalls 4. A wire aperture 5 is positioned at the bottom of main housing 2 in order to allow power cord 27 to extend into the interior of main housing 2. A seal formed of rubber, silicone, or a similar sealant material will make wire aperture 5 water and air tight. Main housings 2 will further include a conventional air nipple 7 with conventional hose engaging ridges 8 such that when a hose or fluid line is attached to air nipple 7, air (or another fluid) may flow into the interior of main housing 2. The upper portion of main housing 2 may include a clamp ring shoulder 9. As best seen in FIG. 3A, this embodiment of claim ring shoulder 9 includes a rounded upper shoulder portion 9A and an outer flat shoulder portion 9B. In one preferred embodiment, main housing 2 will be constructed of an injection molded plastic such as an acrylonitrile-butadiene-styrene copolymer (ABS), but could be constructed of any number of materials having adequate corrosion resistance to outdoor conditions.

Again viewing FIG. 1, lamp housing 15 generally comprises a lamp base 20 which includes a threaded center aperture 31 extending therethrough and into which is threaded lamp socket 29 with a lamp bulb 21. In the embodiment shown, lamp bulb 21 is a conventional incandescent bulb, but could be an LED or other suitable light emitting device. Lamp base 20 will support a clear lamp lens 18 onto which a deflector cap 16 having light directional vanes 17 will be positioned. In one embodiment, lamp base 20 may be cast or milled aluminum while lamp lens 18 may be clear cast acrylic and deflector cap 16 may be injection molded plastic. This embodiment of lamp lens 18 will have machined groves on both ends to receive o-rings 19. After the o-rings 19 are fitted onto lamp lens 18, the lens slips into the machined female grove in the interior of lamp base 20 and deflector cap 16 slides over the lamp lens 18 such that the bottom of direction vanes 17 may snap into the machined groves 32 in the lamp base 20 (best seen in FIG. 2A).

Lamp housing 15 will be connected to main housing 2 by way of a flexible diaphragm 30. In the embodiment shown, flexible diaphragm 30 is formed of a 1/32" or 1/16" thick nylon inserted neoprene rubber which is formed into a frustum or cone shape and then glued or vulcanized along the seam. Naturally, other flexible, substantially air impermeable materials could form flexible diaphragm 30 in other embodiments of the invention. Diaphragm 30 will connect to the lamp base 20 of lamp housing 15 by way of retaining cup 22 which includes a center aperture 23. As best seen in FIG. 2A, one end (the "upper" end) of diaphragm 30 will be positioned between the beveled bottom of lamp base 20 and the mating retaining cup 22. A hollow, all-thread connector tube 24 will pass through retaining cup center aperture 23 (which is not threaded) and engage the threaded center aperture 31 formed in lamp base 20. It will be understood that the tightening of jam nut 25 against retaining cup 22 will force retaining cup 22 against lamp base 20 and hold diaphragm 30 securely in place. Because diaphragm 30 is an elastic, rubber-like material, an air-tight, water-tight seal is formed between retain cup 22 and lamp base 20.

The lower end of diaphragm 30 will be connected to main housing 2 in a similar manner using clamp ring 10, which in the embodiment shown is formed of injection molded plastic. This lower end of diaphragm 30 is placed between the clamp ring shoulder 9 on main housing 2 and the claim ring 10. Clamp ring 10 will then be tightened against ring shoulder 9 by a series of screws 11 inserted along the perimeter of ring shoulder 9. Although the embodiment of FIG. 2A employs stainless steel flat head, counter-sunk machine screws 11, it will naturally be understood that other conventional methods of securing together ring shoulder 9 and clamp ring 10 are within the scope of the present invention. For example, a two piece tapered clamp could be utilized if the shoulder 9 and the clamp ring 10 were tapered in shape to match the clamp. As with lamp base 20 and retainer cup 22, it will be understood that the gripping of diaphragm 30 between ring shoulder 9 and clamp ring 10 forms a substantially air-tight and water-tight seal. Although FIG. 2A illustrates diaphragm 30 connected to the upper edge of main housing 2, other embodiments could have diaphragm 30 connected to any upper portion of main housing 2, but typically above bottom wall 3.

Still viewing FIG. 2A, a further element of landscape light 1 includes a guide member/biasing weight 26. In the embodiment shown, guide member 26 is a disk shaped steel member having a threaded center aperture 28. The outer diameter of guide member 26 will be smaller, but sufficiently close to the inner diameter of main housing 2 such that guide member may easily slide within main housing 2 in a non-contacting, substantially frictionless and seal-less manner, but at the same time provides support to help maintain lamp housing 15 in a centered, upright orientation. Guide member 26 also acts as a biasing weight to pull lamp housing 15 downward when there is not sufficient air pressure in the interior of main housing 2 (as explained in greater detail below). In one embodiment, guide member 26 will weight between about 3 and about 8 lbs. As suggested in FIG. 2A, guide member 26 is attached lamp housing 15 by being threaded onto connector tube 24 and fixed in place with a jam nut 25. The power cord 27 will extend through connector tube 24 and connect to lamp socket 29. In the embodiment shown, power cord 27 has a preformed coil which allows it to easily lengthen when lamp housing 15 is in the raised position, but is re-coiled when lamp housing 15 is in the lowered position as seen in FIG. 3A.

An alternate embodiment of landscape light 1 is seen in FIGS. 4A and 4B. In this embodiment, guide member 26 has been replaced with spring hanger 35. Spring hanger 35 includes a top section 37 with an aperture therein and feet 38 formed at spring hanger 35's lower end. Connector tube 24 may be passed through the aperture and secured to top section 37 with a pair on jam nuts 25. Main housing 2 is also modified in FIG. 4A to include a retaining ring 39 secured to the interior of main housing 2. A retracting spring 36 is positioned between a retaining ring 39 and feet 38. As seen in FIG. 4A, when lamp housing 15 is in the raised position, spring 36 will be compressed and exert a downward bias on lamp housing 15. When the force maintaining lamp housing 2 in the raised position (e.g., air pressure within main housing 2) is not sufficient to overcome the force of compressed spring 36, spring 36 will move lamp housing 15 to the lowered position as seen in FIG. 4B.

Figure 5:
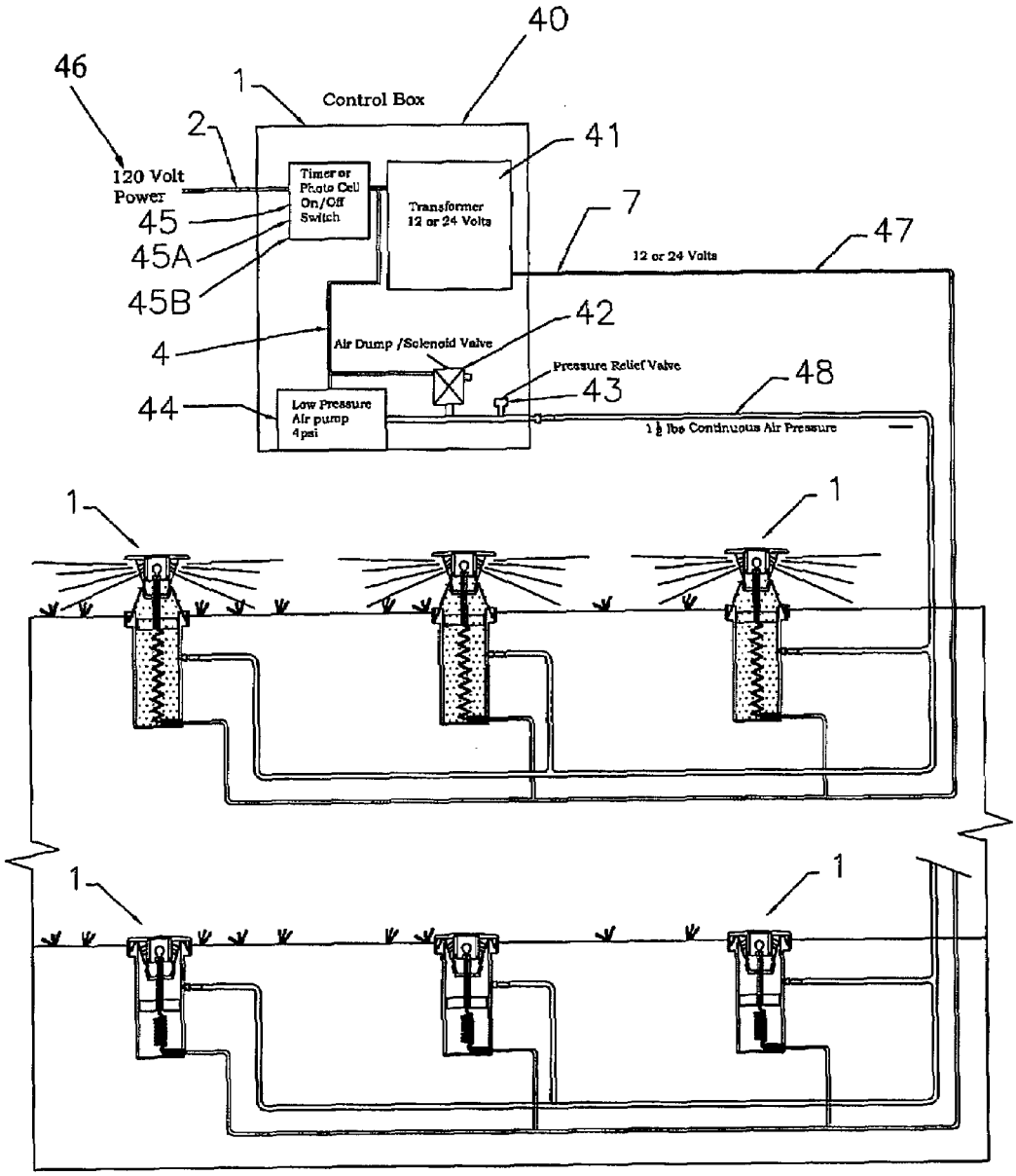
FIG. 5 illustrates one embodiment of the control system for the extendable lighting system of the present invention.

Typically, a series of landscape lights 1 will be used as part of an overall lighting system to light a driveway, walking path, or the like. FIG. 5 illustrates one embodiment of this overall lighting system. Each landscape light 1 will have its main housing 2 positioned below ground level such that in the lowered position, the deflector cap 16 extends no further than about one inch above ground level. An air line 48 will branch to each air nipple 7 and a power line 47 will branch to each power cord 27.

FIG. 5 illustrates the air line 48 and the power line 47 connecting to a unitary control box 40. In the embodiment shown, control box 40 includes an on/off switch 45, a power transformer 41, a low pressure air pump 44, a solenoid activated air dump valve 42, and a pressure relief valve 43. The electrical components of control box 40 will be powered by conventional 120 volt power source 46 (e.g., a standard residential power outlet). On/off switch 45 may be manually activated or it may be an automatic switch such as a timer switch 45A or a photo-activated switch 45B. Timer switch 45A and photo-activated switch 45B will allow the landscape lights 1 to be automatically turned on at dusk and turned off at dawn as desired by the user. The 120 volt power source 46 will typically be stepped down to either 12 or 24 volts by transformer 41 depending on the voltage rating of the other components in control box 40. Transformer 41 supplies low voltage power to the lamps 21. Switch 45 will supply the required voltage to air pump 44 and air dump valve 42 via power line 4 while air line 48 is connect to the output of air pump 44. In the embodiment shown, air pump 44 may be a low pressure (about 4 psi max), high efficiency, positive displacement pump such as, in one non-limiting example, a conventional aquarium pump manufactured by Rolf C. Hagen Corporation of Montreal, Canada under the designation "Optima". In such an embodiment, it is preferred that the pump provide air at a rate of less than about 5000 to about 20,000 cc/min. Because a positive displacement pump may be damaged if it must pump against a pressure much higher than its rating, a pressure relief valve 43 may be placed in air line 48. In this embodiment, pressure relief valve 43 may be in one example a "500 Series Adjustable Inline Relief Valve" manufactured by Circle Seal Controls, Inc., of Corona, Canada and set to release pressures of over about 1.5 psi. This will allow air pump 44 to operate continuously without damage. As one example, solenoid activate dump valve 42 may be a "Body-Ported Solenoid Control Valve" manufactured by Mead Fluid Dynamics of Chicago, Ill. Solenoid activated dump valve 42 will be of a type which is closed when power is supplied and open when the solenoid is not energized.

When switch 45 activates the system, air pump 44 will begin pumping air while at the same time solenoid valve 42 is energized causing it to move to the closed position (i.e., closing off the air dump outlet). As pressure increases in the main housing 2 of each landscape light 1, the lamp housing 15 will move to the raised position. In the embodiment of landscape light 1 seen in FIG. 2A, a gauge pressure (i.e., above atmospheric pressure) of about 1.5 psi acting against the interior of diaphragm 30 and the bottom of cup 22 will be sufficient to fully extend lamp housing 15. Returning to FIG. 5, it can be seen how pressure relief valve 43 acts to release compressed air at any time the pressure in the system exceeds 1.5 psi.

At a time or under lighting conditions when switch 45 moves to the off position, power to the lamps, pump 44 and solenoid valve 42 is cut. Pump 44 will then cease to supply compressed air and solenoid valve 42 returns to the open position, thereby allowing any positive pressure in the system to equalize to atmospheric pressure. Without positive pressure within main housing 2 of landscape lights 1, the weight of the guide member as suggested in FIG. 3A (or tension in the spring 36 in FIG. 4A), causes lamp housing 15 to sink back into main housing 2 as suggested in the lower portion of FIG. 5.

Figure 6:
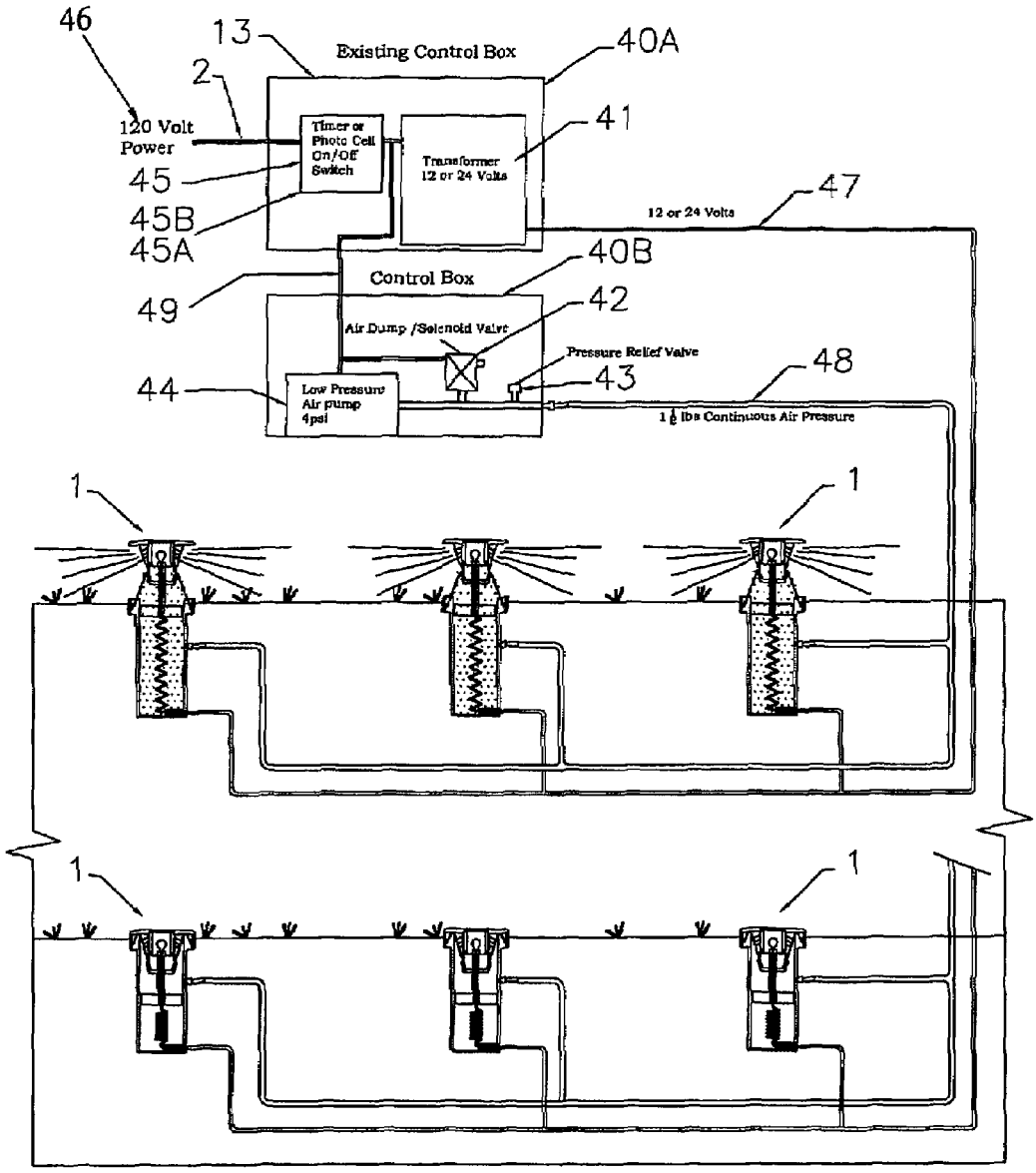
FIG. 6 illustrates an alternate embodiment of the control system for the extendable lighting system of the present invention.

Although FIG. 5 illustrates an integrated control box 40, an alternate embodiment seen in FIG. 6 demonstrates how an existing control box 40A of a prior art lighting system could be employed with a retro-fit control box 40B of the present invention. The control box 40A could be the control box for an existing prior art lighting system where the landscape lights are stationary above ground lights. Existing control box 40A would include a timer 45 and a transformer 41 supplying current to an existing power line 47 running to the stationary landscape lights (not shown). This prior art system could be retrofitted to an embodiment of the current invention by first replacing the stationary landscape lights with the landscape lights 1 positioned in the ground as described above. The existing power line 47 would be connected to landscape lights 1. A new air supply line 48 would be connect to each landscape light 1 and supplied with pressurized air by the pump 44 in retro-fit control box 40B. Retro-fit control box will also include solenoid dump valve 42 and pressure relief valve 43. All components of retro-fit control box 40B are powered by a connecting line 49 from the existing power source. It will be understood that the retro-fitted system will then operate in a manner identical to that described in reference to FIG. 5.

Although described in reference to specific embodiments, there are many variations and modifications which fall with in the scope of the present invention. As further nonlimiting examples, the landscape lights 1 could be installed in a concrete slab or side walk. Nor is the present invention limited to ground located lighting. The embodiment of FIG. 4 could readily be employed as retractable lighting in ceilings or walls. Nor is the present invention necessarily limited to pneumatic operation, but could operate on other fluids (e.g., water). Nor is the invention limited lighting applications, but could be used whenever it is desired to have an object extended and retracted from a ground/floor, overhead, or wall area. For example, the invention could be used to raise and lower decorative items or markers such as small flags, or to raise and lower boundary markers around the perimeter of a football, soccer, or other sports field. In the case of boundary markers, the markers could collapse if a player fell on the marker. Also, the flexible diaphragm would allow the marker to bend sideways when struck by a player, but then return to an upright position. All such modifications and variations are intended to fall within the scope of the following claims.

I claim:

1. An extendable lighting system comprising:

a. a main housing having a bottom wall and upwardly extending side walls;

b. a lamp housing retractable within said main housing;

c. a flexible diaphragm connected to said main housing above said bottom wall and connected to said lamp housing to create a substantially enclosed space between said diaphragm and said bottom wall;

d. a sliding guide member in substantially seal-less orientation with respect to said sidewalls of said main housing; and e. an air passage communicating with said enclosed space.

2. The extendable light system according to claim 1, wherein said diaphragm is connected to an upper portion of said main housing.

3. The extendable light system according to claim 2, wherein said diaphragm is connected to an upper edge of said main housing.

4. The extendable light system according to claim 1, wherein said guide member has a cross-sectional shape generally conforming to an interior cross-section of said main housing.

5. The extendable light system according to claim 1, wherein a combined weight of said guide member and said lamp housing is at least about 3 pounds.

6. The extendable light system according to claim 1, wherein said guide member is connected to said lamp housing.

7. The extendable light system according to claim 1, wherein a power cord enters said housing below said diaphragm and connects to a lamp socket in said lamp housing.

8. The extendable light system according to claim 1, wherein a lamp is positioned in said lamp housing and a power cord communicates with said lamp.

9. The extendable light system according to claim 1, wherein said main housing is connected to an automatic switch device and a fluid pump for providing fluid to said main housing.

10. The extendable light system according to claim 9, wherein said automatic switch device also provides power to said lamp housing.

11. The extendable light system according to claim 9, wherein said fluid pump is a low power air pump providing air at a rate of less than about 5000 to about 20,000 cc/min.

12. The extendable light system according to claim 9, further comprising a valve for maintaining or releasing positive pressure within said system.

13. The extendable light system according to claim 12, wherein said valve is generally in a closed position when said pump is operating and generally in an open position when said pump is not operating.

14. The extendable light system according to claim 1, further including a plurality of said lighting systems each connected to a power source and a fluid source, said fluid source being controllable to periodically generate and release a positive pressure within said main housings of said lighting systems.

15. The extendable light system according to claim 1, wherein said sliding guide member comprises a spring hanger connected to said lamp housing and a spring biasing said lamp housing in a downward direction.

16. An extendable lighting system comprising:

a. a main housing having a bottom wall and upwardly extending side walls;

b. a lamp housing retractable within said main housing;

c. a flexible diaphragm connected between said main housing and said lamp housing to create a substantially enclosed space between said diaphragm and said bottom wall;

d. a weight connected to said lamp housing and biasing said lamp housing downward;

e. a sliding guide member in substantially seal-less orientation with respect to said sidewalls of said main housing, and f. an air passage communicating with said enclosed space.

17. The extendable light system according to claim 16, wherein said weight moves along said side walls in a seal-less manner.

18. The extendable light system according to claim 16, further including a plurality of said lighting systems each connected to a power source and a fluid source, said fluid source being controllable to periodically generate and release a positive pressure within said main housings of said lighting systems.

19. The extendable light system according to claim 16, wherein said weight is incorporated into said sliding guide member.

20. An extendable lighting system comprising:

a. a main housing having a bottom wall and upwardly extending side walls;

b. a lamp housing retractable within said main housing;

c. a flexible means for connecting said main housing above said bottom wall to said lamp housing to create a substantially enclosed space between said flexible means and said bottom wall;

d. a sliding guide member in substantially seal-less orientation with respect to said sidewalls of said main housing; and e. an air passage communicating with said enclosed space.

* * * * *